US005373996A

United States Patent [19]

Hamada

[11] Patent Number: 5,373,996

[45] Date of Patent: Dec. 20, 1994

[54] GRANULAR MATERIAL PROCESSING APPARATUS

[75] Inventor: Kenji Hamada, Tokyo, Japan

[73] Assignee: Nara Machinery Co., Ltd., Tokyo, Japan

[21] Appl. No.: 34,270

[22] Filed: Mar. 22, 1993

[30] Foreign Application Priority Data

Mar. 25, 1992 [JP] Japan ..... 4-098869
Mar. 12, 1993 [JP] Japan ..... 5-051778

[51] Int. Cl.[5] ..... B02C 15/08

[52] U.S. Cl. ..... 241/65; 241/126; 241/129

[58] Field of Search ..... 241/123, 125, 126, 129, 241/65

[56] References Cited

U.S. PATENT DOCUMENTS 1,737,854 12/1929 Kreutzberg .
1,774,464 8/1930 Wood .
3,467,318 9/1969 Dubrovin et al. ..... 241/123
4,711,402 12/1987 Dräger et al. ..... 241/101.2
4,919,347 4/1990 Kamiwano et al. ..... 241/65
5,193,754 3/1993 Pujol ..... 241/65

FOREIGN PATENT DOCUMENTS 848151 8/1949 Germany .
1916235 10/1970 Germany .
2445631 4/1975 Germany .
291876 10/1953 Switzerland .

*Primary Examiner*—Mark Rosenbaum
*Assistant Examiner*—John M. Husar
*Attorney, Agent, or Firm*—McGlew and Tuttle

[57] ABSTRACT

This invention relates to a granular material processing machine characterized by the presence of a reviving main shaft in the center of a container, and the installation of multiple sub-shafts supported around the said main shaft at certain intervals, wherein multiple ring-shaped parts are fitted to said sub-shafts so that there will be sufficient space among the sub-shafts, and said ring-shaped parts are made to come into contact with the inner walls of the container.

17 Claims, 13 Drawing Sheets

GRANULAR MATERIAL PROCESSING APPARATUS

FIELD OF THE INVENTION

This invention relates to a granular material processing apparatus, and more particularly, to an apparatus which can be used to pulverize granular material, mixing granular material and liquid, and to disperse pigments and paints uniformly, in particular, highly-viscous slurry substances.

BACKGROUND OF THE INVENTION

Numerous types of machines have been intended for use in the pulverizing and dispersion of granular material. Japanese Publication of Unexamined Patent Application KOKAI Number SHO58-17851 describes one capable of pulverizing granular material to sub-micron size.

This apparatus is equipped with a housing containing a cylindrical inner surface, the inside of which housing contains a shaft driven by a motor, a set of driving plates fixed to the shaft, a shaft with the flexibility of a cable fixed to the two driving plates and parallel to the above-mentioned shaft, and a rotor assembly consisting of three rollers which revolve freely in relation to the above driving plates.

When the motor causes the shaft to revolve mainly by the centrifugal force generated by the revolution of the rotor assembly in conjunction with the shaft, the flexible shaft will bend, and each roller will be pressed against the inner surface of the housing while revolving in the opposite direction from that of the shaft. This mechanism effects processes such as pulverization by grinding the granular materials between the rollers and the inner surface of the housing.

In the rollers of the above-mentioned apparatus spiral grooves are cut, and these spiral grooves convey processing materials from the top of the driving plates downward. However, when the apparatus is used to pulverize particles, as shown in FIG. 8, a large particle may become caught between one of the convex portions (102) of the outer surface of the roller (101) and the inner surface (103) of the housing. In such a case, compressive and shearing forces are not applied to the particles which are located between the other convex portions (102) and the inner surface (103) of the housing. In addition, force is not applied to the particles located in the spiral grooves (104). As a result, the outer surface (102) of the roller (101) does not function effectively.

Even if the outer surface (102) of the roller (101) is finished sufficiently flat so that it comes into close contact with the inner surface (103) of the housing, extended periods of normal use or short period of use with highly abrasive granular material will cause the convex portion (102) of the aforementioned roller (101) to wear out and its shape to change. As a result, the whole surface will not function effectively.

Moreover, in the above apparatus, since the method of mounting roller (101) to the flexible shaft is very complicated, highly skilled labor has been required to replace it. Cleaning the apparatus by disassembling it has been also difficult, and replacing roller (101) is a specialized task. Manufacturing roller (101) has also been very labor-intensive, so the apparatus has been very expensive.

OBJECTS AND SUMMARY OF THE INVENTION

In consideration of the above-mentioned problems, the object of this invention is to provide a machine which can effectively pulverize granular materials, mix and disperse granular materials into liquid, and uniformly disperse pigments and paints.

This invention fulfills the objective and solves the above-mentioned problems through providing of a revolving main shaft in the center of the container, supporting at least two sub-shafts around said main shaft at equal distances; fitting said sub-shafts with multiple ring-shaped parts that ensure sufficient space among the sub-shafts; and configuring said ring-shaped parts so that they come into contact with the inner walls of the aforementioned container.

DETAILED DESCRIPTION OF PREFERRED EMBODIMENTS

Figure 1:
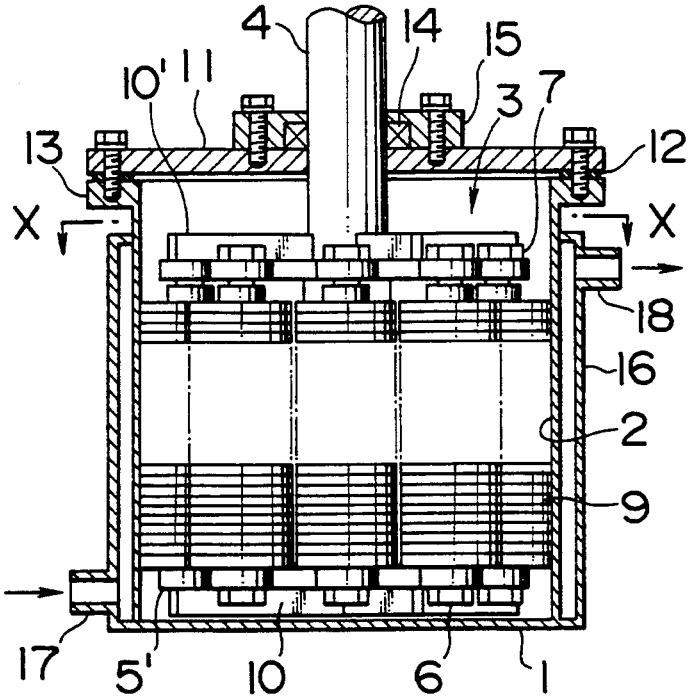
FIG. 1 shows a cross-sectional drawing of an embodiment of the invention.

A detailed explanation will be given to the present invention below while referring to the drawings of the apparatus based on this invention.

Figure 2:
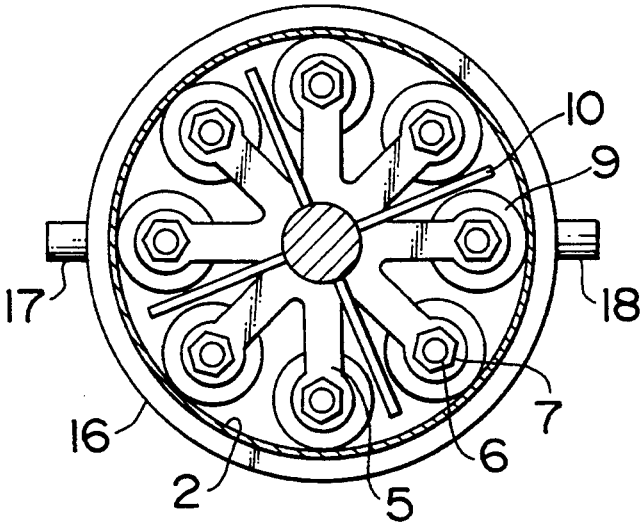
FIG. 2 shows an X—X cross-section drawing of the apparatus shown in FIG. 1.

An embodiment of the invention apparatus are shown in FIG. 1 and FIG. 2.

This machine is a batch-type processor of granular material. Based on these figures, a detailed explanation of this invention will be given.

Numeral (1) in the figure indicates a cylindrical container. This container (1) possesses an inner surface (2) which has a longitudinal central axis. Inside the container (1) (which serves as the processing chamber) is the rotary mechanism (3), shown in cross-section in FIG. 3.

In this rotary mechanism (3), numeral (4) indicates the main shaft which shares the same central axis as the above-mentioned cylindrical container (1). Numerals (5) and (5') are a set of presser plates fixed to the main shaft (4) in the longitudinal direction at a certain distance. Numeral (6) are the sub-shafts, which are fixed to the aforementioned presser plates (5) and (5') so that they will be positioned parallel to, and equidistant from, the main shaft (4). The above-mentioned presser plates (5) and (5') are shaped such that the number of arms protruding from the disc-shaped part are equal to the number of the sub-shafts (6). The presser plates (5) and (5') are not merely disc-shaped pieces, but instead have gaps between each arm so that the granular materials will be better mixed when they are processed in container (1). In addition, this minimizes the amount of granular material that will accumulate on top of the presser plate (5). The above-mentioned sub-shaft (6) is a rather long bolt-type part, and it is fixed by a nut (7) after it has passed through the hole located at the tip of the arm portion of both presser plates (5) and (5').

At the top portion of the above-mentioned main shaft (4), a drive source (hereinafter, illustrations will be omitted) such as a motor is directly connected. In addition, pulleys are mounted to form a structure by which the revolution from the drive source is transmitted to the main shaft (4) via the V belts.

Figure 3:
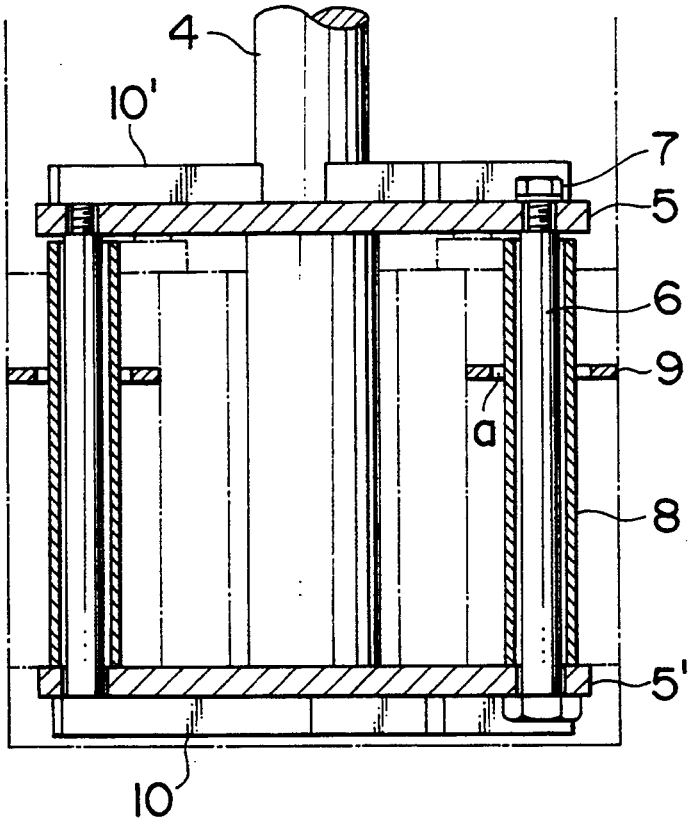
FIG. 3 shows a detailed cross-sectional drawing of the agitator mechanism for the apparatus shown in FIG. 1.
Figure 4A:
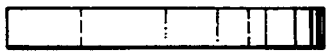
FIG. 4 shows an example of the ring-shaped part used in this invention: (a) is a front view and (b) is a perspective view.
Figure 4B:
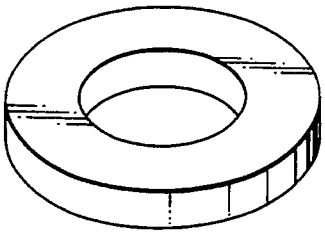
Figure 5A:
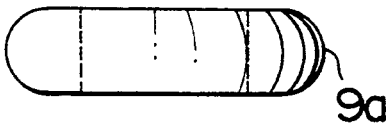
FIG. 5 shows a drawing of another example of the ring-shaped part used in this invention: (a) is a front view and (b) is a perspective view.
Figure 5B:
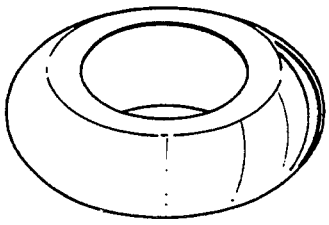

Numeral (8) is the collar fitted to the sub-shaft with a small gap, and (9) signifies the multiple ring-shaped parts mounted to the collar (8), which allows the rings to revolve freely. As shown in FIG. 3, the inside diameter the above-mentioned, ring-shaped parts (9) shall be sufficiently larger than the outside diameter of the collar (8). The structure must be designed so that sufficient space (a) exists between the inner surface of the ring-shaped parts and the outer surface of the collar when the outer surface of the ring-shaped parts (9) come into contact with the inner surface (2) of the container (1). The ring-shaped parts (9) should not be tightly packed between the two presser plates (5) and (5'), and a small tolerance (although this will vary depending on the thickness of the ring-shaped parts (9), a space of two or three rings will be required) shall be provided between the upper surface of the layer of ring-shaped parts (9) and the lower surface of the upper presser plate (5). By so doing, each ring-shaped part (9) will be able to move freely around the collar (8). The ring-shaped parts (9) have cylindrical shapes, and as FIGS. 4 and 5 show their upper and lower surfaces are parallel. They may be something like washers having smooth top and bottom surfaces as well as smooth peripheral surface, and in order to prevent the nipping (eating away) by granular material, they may also be shaped to conform with the various curved surfaces (9*a*) on the peripheral surface, as necessary. Installed on the main shaft (4), which is located at the lower portion of the lower presser plate (5') or, if necessary, on the top portion of the upper presser plate (5) and/or the main shaft (4) located in the middle of the two presser plates (5) and (5') (illustration is omitted), are agitation blades (10) and (10') used to agitate the granular materials processed in the inside of the container (1).

Numeral (11) indicates the top cover, which contains a hole through which the main shaft runs. This top cover (11) is fixed to the flange portion (13) of container (1) by binding parts such as bolts and nuts; the packing (12). Numeral (14) is the oil seal, and (15) is an oil seal holder, which has a notch to accommodate the oil seal (14).

This invention is designed to process various materials by transmitting compressive force and shearing force through the ring-shaped parts that revolve along the inner surface (2) of the container (1). Thus, even if a slurry substance is being processed, temperature in the apparatus would normally increase as processing continued. Certain resins fuse at temperatures over 40° C. To avoid this, the side walls of the container (1), at a minimum shall be made into a jacket structure (16), which is equipped with a refrigerant-refill opening (17) and drainage (18). Various refrigerants shall be supplied to the inside of the jacket (16) so that the granular materials in the container (1) will be cooled.

The above-mentioned apparatus normally mounts the top cover (11) to the frame with binding parts (hereinafter illustrations are omitted), and a jack or air cylinder is connected to the lower part of the container (1) to raise and lower it.

Figure 6:
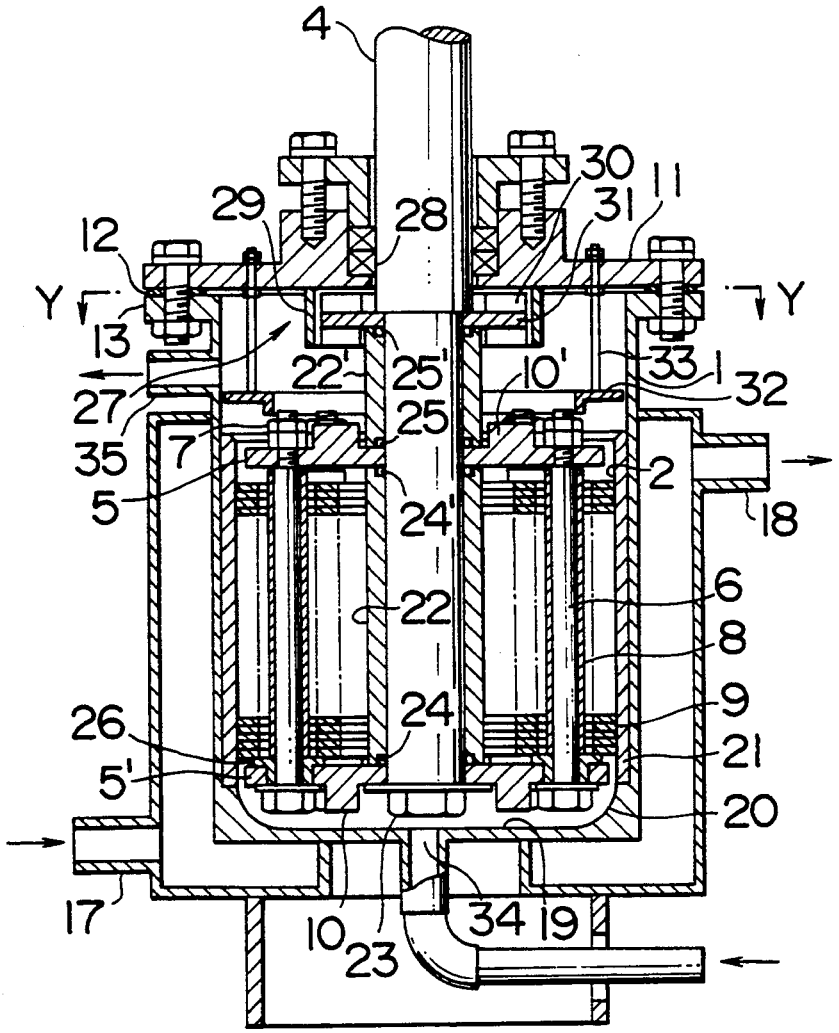
FIG. 6 shows a longitudinal section of another embodiment of the invention.
Figure 7:
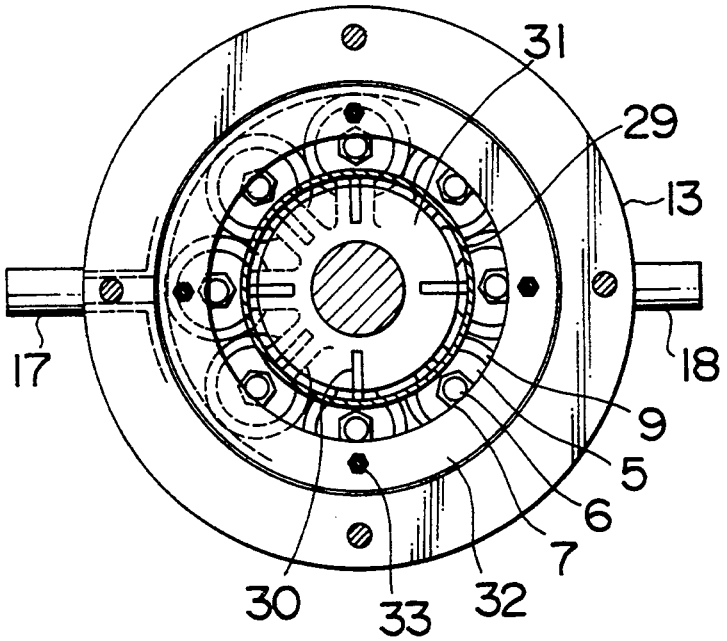
FIG. 7 shows a Y—Y longitudinal section drawing of the apparatus shown in FIG. 6.

FIGS. 6 and 7 show other examples of the apparatus of this invention. The example apparatuses shown here can process materials continuously, and the same symbols shall be used for parts already covered in previous examples.

In the same figure, the corner portion (20), which is formed by the inner surface (2) and the bottom surface (19) of the container (1), can be curved to ensure that the materials in container (1) do not stagnate in the corner portion (20). Numeral (21) is a cylindrical part fitted to the inner surface (2) of container (1). In this apparatus, the ring-shaped parts (9) receive the centrifugal force of the rotary mechanism (3), which revolves together with the revolution of the main shaft 4. While being strongly pressed against the inner walls (2) of the container (1), the ring shaped part slide slightly along the inner walls and revolve in the opposite direction from that of the main shaft (4). In other words, the ring-shaped parts (9) and the inner walls (2) rub against each other. Since the apparatus is designed to process (e.g. pulverize) material between the ring-shaped parts and the container walls, a certain degree of wear on the inner walls (2) of the container (1) and on the ring-shaped parts (9) is expected. Thus, by fitting cylindrical part (21) inside the inner walls (2), wear is controlled since only the cylindrical part (21) need be replaced. Furthermore, by making the cylindrical part (21) from abrasion resistant materials such as ceramics or super-hard substance, wear can be minimized, and fine abrasion particles can be kept from the processing materials.

Figure 9A:
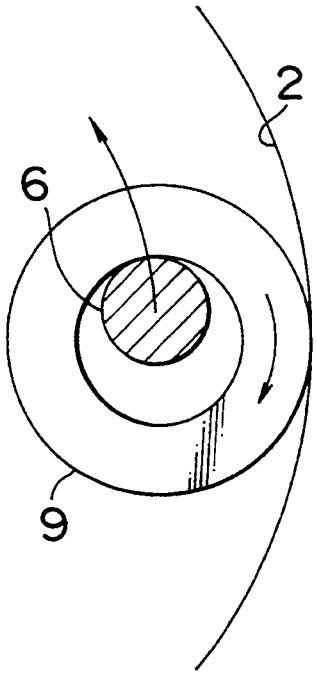
FIG. 9 shows an explanatory drawing of the movement of the revolving mechanism of this invention: (a) an explanatory drawing of the movement of the revolving mechanism structure in which there is only a ring-shaped part, the sub-shaft, and (b) an explanatory drawing of the movement of the revolving mechanism a collar is fitted to the sub-shaft, and this collar is equipped with a ring-shaped part.
Figure 9B:
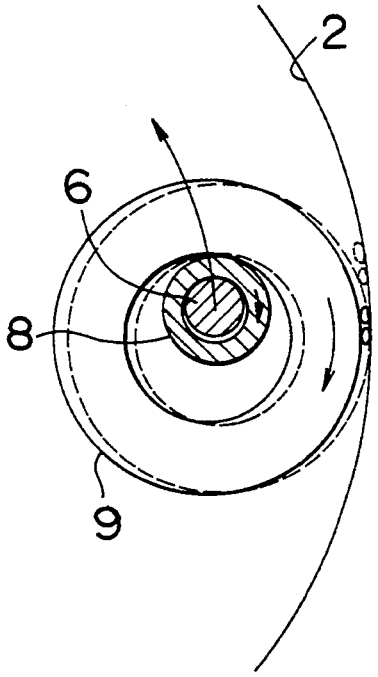

FIG. 9 shows the movements of the sub-shafts (6) and the ring-shaped parts (9). As FIG. 9(*a*) indicates, a structure consisting only of ring-shaped parts (9) and sub-shafts (6) which are fixed to the presser plates (5) and (5') (illustration is omitted) will cause local wear to occur on the outer surface of the sub-shafts (6), as a result of the contact (or sliding motion) between the inner surface of the ring-shaped parts (9) and the sub-shafts. Thus, as FIG. 9(*b*) shows, by fitting the collar (8) having an inside diameter slightly larger than the outside diameter of the sub-shafts (6), and allowing the ring-shaped parts (9) to revolve freely around the collar (8), wear on the sub-shafts (6) can be prevented. At the same time, the collar (8) will also revolve, though less than the ring-shaped parts (9), and cause the contact point between the ring-shaped parts (9) and the collar (8) to move. Thus, even if the collar (8) becomes worn, it will do so uniformly over its whole outer surface, rather than develop local abrasions. The collar (8) thus needs to be replaced less often. Furthermore, none of the associated parts should need to be replaced. As was the case with the cylinder part (21), the collar (8) can be made from abrasion-resistant materials such as ceramics or super-hard substances, and wear can be further prevented. Once again the problem of contamination of the processed materials by fine abrasion particles is prevented. The ring-shaped parts (9) should also be made from the same or similar materials in such cases.

The presser plates (5) and (5') are mounted on the main shaft using the main shaft collars (22) and (22') which are fitted to the main shaft (4). The presser plates (5) and (5') are laid out at certain intervals along the length, of the main shaft (4) and then fixed in place by fastening the nut (23) on the threaded tip of the main shaft (4). Key grooves (hereinafter, illustrations are omitted) shall be cut in the main shaft (4) and the two presser plates (5) and (5'), and a key shall be inserted into each key groove and fixed in position. In this way, the revolution of the main shaft (4) is transmitted to the presser plates (5) and (5'). Furthermore, by making notches inside both ends of the two main shaft collars (22) and (22'), and fitting the O rings (24), (24'), and (25), (25'), respectively, processing material can be prevented from entering between the main shaft (4) and the main shaft collars (22) and (22'), and solidifying there, causing those parts to stick.

When abrasion-resistant materials such as ceramics are used for the ring-shaped parts (9), but not for the lower presser plate (5'), the sliding action of the ring-shaped parts (9), will cause the lower presser plate (5') to wear out. Thus, bushings with collars made of identical or similar material as that used in the ring-shaped parts (9) should be fit into the hole in the lower presser plate (5').

In addition, the agitation blades (10) and (10') may be integrated with the lower surface of the lower presser plate (5') or upper surface of the top presser plate (5). Agitation blades (illustration omitted) may also be installed on the main shaft collar (22). Numeral (27) indicates a mechanism for preventing the processing material in container (1) from spraying through the shaft-sealing portion (28) of the top cover (11). This mechanism (27) is composed of a cylindrical part (29) connected to the top cover (11), disc (31) that has blades (30) laid out radially at certain intervals on both surfaces. This disc (31) will revolve together with the main shaft when key grooves are made in the main shaft (4) and the disc (31) (hereinafter illustration is omitted), and keys are inserted into the key grooves to fix the two parts together.

A baffle plate (32) prevents the scattering of the processed material and acts as a baffle for preventing insufficiently processed material from leaving container (1) in cases the apparatus is used for continuous processing. It is fixed in place by the binding parts (33) that extend from the top cover (11). The baffle plate (32) is ring-shaped and has cylindrical portions that protrude downwards from the inner walls in the manner illustrated The edges of this baffle plate (32) should come as close as possible to the inner walls (2) of the container (1). Furthermore, the baffle plate (32) may have only a simple ring shape in certain cases.

Figure 10:
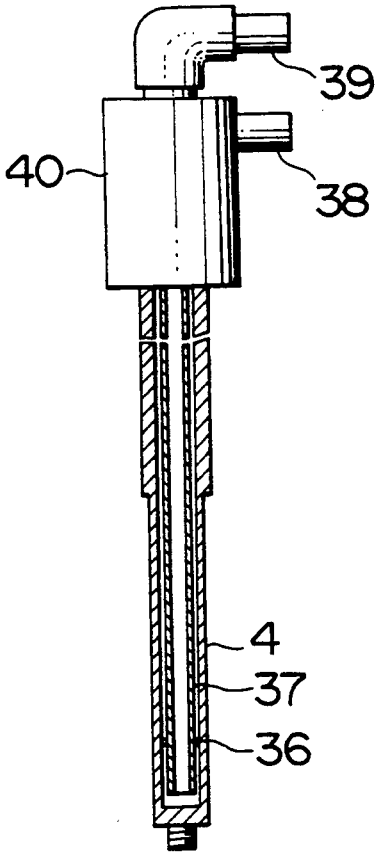
FIG. 10 shows a detailed drawing of the other model of the cooling mechanism used in this invention.

In applications involving continuous processing, such as wet milling, a processing material supply opening (34) shall be made at the bottom (19) of the container (1), a discharge opening (35) at the top portion of the inner surface (2) of the container (1) shall also be made. Milling (pulverization) can be done continuously by using a pump or similar implement to supply the processing materials to the apparatus. Even in such apparatus configurations, the side walls and the bottom (19) of the container (1) can be made into a jacket structure (16). As an auxiliary means the main shaft (4) can be hollow, if necessary, as shown in FIG. 10, and a cylinder (37) with multiple protrusions designed to center the tip portion and to prevent deflection may be inserted into the hollow shaft. At the same time, a rotary joint (40) containing a refrigerant-feeding opening (38) and discharge opening (39) shall be connected to the portion of the main shaft (4). A refrigerant-supply circuit shall be formed by continuously supplying various refrigerants from the feeding opening (38) into the space between the cylinder (37) and the main shaft (4), via the inside of rotary joint (40). From the interior of cylinder (37), the refrigerant shall be discharged from the discharging opening (39) via the inside of the rotary joint (40). By cooling the main shaft (4) and the presser plates (5) and (5') that are connected to the main shaft, the processed material inside the container (1) can be cooled.

The method of assembling this apparatus is discussed below, using FIGS. 6 and 7 as examples.

First, insert the disc (31), and main shaft collar (22') containing O rings (25) and (25') in its notched portions, top presser plate (5), main shaft collar (22) containing an O ring (24) and (24') in its notched portions and the bottom presser plate (5') onto the main shaft (4), in the order given. The nut (23) is fitted to the threaded bottom tip of the main shaft (4) so as to fix the inserted parts in place. All keys shall be inserted into their respective key grooves, and the associated parts fixed into position. Subsequently, a bushing (26) is fitted into each hole in the bottom presser plate (5'), and each collar (8) is placed with the necessary number of ring-shaped parts on top of the collar of the bushing (26). Once each collar (8), each bushing (26), the top presser plate (5) have been aligned so that their respective holes are in place, the sub-shaft (6) is inserted through these holes, starting from the lower side of the bottom presser plate (5'). It is then fixed in place with the nut (7). Next, the container (1) is raised from the lower side with a jack or an air cylinder. After the packing (12) is inserted between the top cover and the flange portion (13) of the container (1), they are fixed in place with the binding parts.

Next, an explanation will be given on the method for wet milling batches of solid substances using the apparatus shown in FIGS. 1 and 2.

First, a slurry comprising a substance to be milled and a dispersant such as water is prepared. The ratio of solid substance to dispersant in this slurry will vary depending on physical properties such as material particle size, true density, and shape, but 5–50 weight percent is generally desirable.

A suitable amount of the slurry material prepared above shall be added to the container (1), and the container (1) shall then be fixed to the top cover (11). Precisely what is "suitable" will vary depending on the operating conditions, such as the RPM level of the main shaft (4), but 35–80 percent of the actual volume of container (1) is generally appropriate. Prior to starting the operation, cooling water is started to be continuously supplied to the jacket (16) from the refrigerant charging orifice (17).

Next, as for the speed of the outermost peripheral orbital plane of ring-shaped parts 9, for instance, if the main shaft (4) revolves at 10 m/sec, centrifugal force acts on the ring-shaped parts (9) and they move towards the periphery. In other words, the ring-shaped parts (9) will be pressed against the inner walls (2) of the container (1), and, while slipping, will also revolve slightly along said inner walls (2) in the opposite direction to that of the main shaft (4). The slurry material in the container (1) will be agitated by the agitator blades (10) mounted to the lower side of the main shaft (4), and by the revolution of the ring-shaped parts (9), centrifugal force also acts on the slurry, and presses it against the inner walls (2) of the container (1).

The slurry material will rise along the inner walls (2), then return to the center of the container (1). In this way, the slurry material will form a convection current (the so-called straw rope twisting movement) in the container (1). As shown in FIG. 9(*b*), when the processed material (solid substance) comes between the ring-shaped parts (9) and the inner walls (2), a gap the size of the solid particles is made. In terms of the same figure, the ring-shaped parts (9) will move from the position indicated by the dotted lines to that by the solid lines, and the solid particles will be crushed by the compressive and the shearing forces applied by the ring-shaped parts (9). Through repetition, the solid substances will be finely milled in a very short time.

Figure 8A:
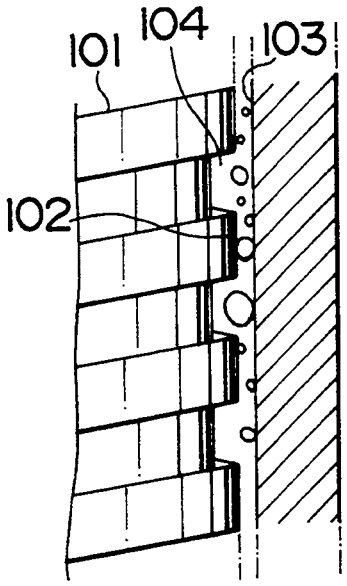
FIG. 8(a) PRIOR ART
FIG. 8 shows a processing mechanism of the apparatus and a conceptual drawing showing the pulverizing mechanism used for solid materials: (a) shows the processing mechanism of a conventional machine, and (b) shows the processing mechanism of the invention.
Figure 8B:
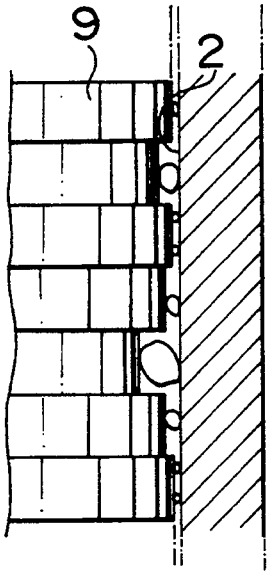

Furthermore, since the ring-shaped parts (9) can move independently, as shown in FIG. 8(*b*), each ring-shaped part (9) traps solid particles between itself and the inner walls (2) and will be able to apply compressive and shearing forces to the solid particles. In addition, there is sufficient space between the layers of ring-shaped parts (9) and the top presser plate (5), for slurry material to enter between the individual ring-shaped parts (9). A lubricating effect is created by this slurry, causing the ring-shaped parts (9) to move even more smoothly. Additionally, the sliding action of the ring-shaped parts (9), creates a small, additional force on solid particles which come between them.

At this time, as the speed for the outermost peripheral orbit plane of the above mentioned ring-shaped parts should be range of about 5–20 m/sec. If the speed is slower, milling time increases, the compressive and shearing forces of the ring-shaped parts (9) become weak, and operations are ineffective. If the speed exceeds this range however, the compressive and shearing forces of the ring-shaped parts do increase, but the slurry substance becomes over-agitated and ends up adhering in places such as the top cover (11). Again, operation in such conditions will be ineffective. After a given period of time has elapsed, terminate the process by stopping the motor, and then remove the parts which bind the flange portion (13) of the container (1) with the top cover (11). If the container (1) is lowered using a jack or air cylinder, only milled slurry will remain in the container (1) and it can then be removed.

Next, an explanation of the method of continuously milling wet solids is given using the apparatus shown in FIGS. 6 and 7.

Given that the rotary mechanism (3) has been assembled beforehand, the container (1) is fixed to the top cover (11). A a continuous flow of cooling water from the refrigerant-charging opening (17) is supplied to the jacket (16).

Next, a continuous flow of slurry material from the processing-material supply opening (34) at the bottom (19) of the container (1) is supplied into container (1) itself. The liquid level of the slurry inside the container (1) will rise gradually. Although the amount will vary depending on the speed of the rotary mechanism, the main shaft (4) can generally be set in motion when the amount of slurry material reaches about 20 to 30 percent of the effective volume of the container (1). Centrifugal force will then act on the ring-shaped parts (9), pressing their peripheral surfaces against the inner walls (2) of the container (1). As they did during the batch milling process, the ring-shaped parts revolve slightly in the direction opposite to that of the main shaft (4) as they move and slip along said inner walls (2). The slurry material in container (1) will be agitated by the agitation blades (10) mounted on the bottom of the lower presser plate (5') and by the revolution of the ring-shaped parts (9). Centrifugal force acts on the slurry as well, and presses it against the inner walls (2) (21) of the container (1). After rising up these inner walls (2) (21), the slurry material will return to the center of the container. As was the case during batch processing, the solids contained in the slurry will be crushed by the compressive and shearing forces applied by the ring-shaped parts (9). Repetition of this action causes, the solid particles to be rapidly crushed.

During this time, the slurry material is continuously supplied to container (1) from the supply opening (34), so the liquid level will continue to rise. Eventually, the slurry will pass between the main shaft (4) (main shaft collar 22) and baffle plate (32), and be discharged continuously from the discharge opening (35). The effects of inertia dictate that when the viscosity of the slurry is lower (i.e., if the concentration is lower), the solid substances particles in the slurry will tend to separated based on size, large particles will remain in the container (1) until they have been pulverized into small particles. Only small particles will be discharged. Thus, a continuous flow of milled particles can be easily obtained. The final particle size of the milled product obtained continuously by the milling process is mainly controlled by the supplying speed (the residence time in the container (1)) of the slurry material.

In the event that an organic solvent is used as the dispersant, the air inside the container (1) should be replaced with an inert gas such as nitrogen in order to prevent fire and explosion. For batch processing, the slurry material is added to the container (1) first. After fixing container (1) to the top cover (11), the inert gas supply and discharge openings (hereinafter illustration is omitted) on the top cover (11) can be opened; the inert gas will then displace the air inside the container (1) quite rapidly. Later, the charging and discharging openings are reopened, and the main shaft (4) is revolved and processing is carried out in the manner discussed above. In cases where processing is continuous, the inert gas is supplied through the inert gas supply opening on the top cover (11), and discharged through the processed material discharge opening (35). Once this flow has been established, slurry material can be supplied from the supply opening (34) continuously, and processing can proceed as outlined above. During processing, both the inert gas and the processed slurry material will be discharged continuously from the discharge opening (35).

EXAMPLES

An explanation of the process for batch milling wet solids comprised of heavy calcium carbonate with an average particle size of 10 μm is given below.

Figure 11:
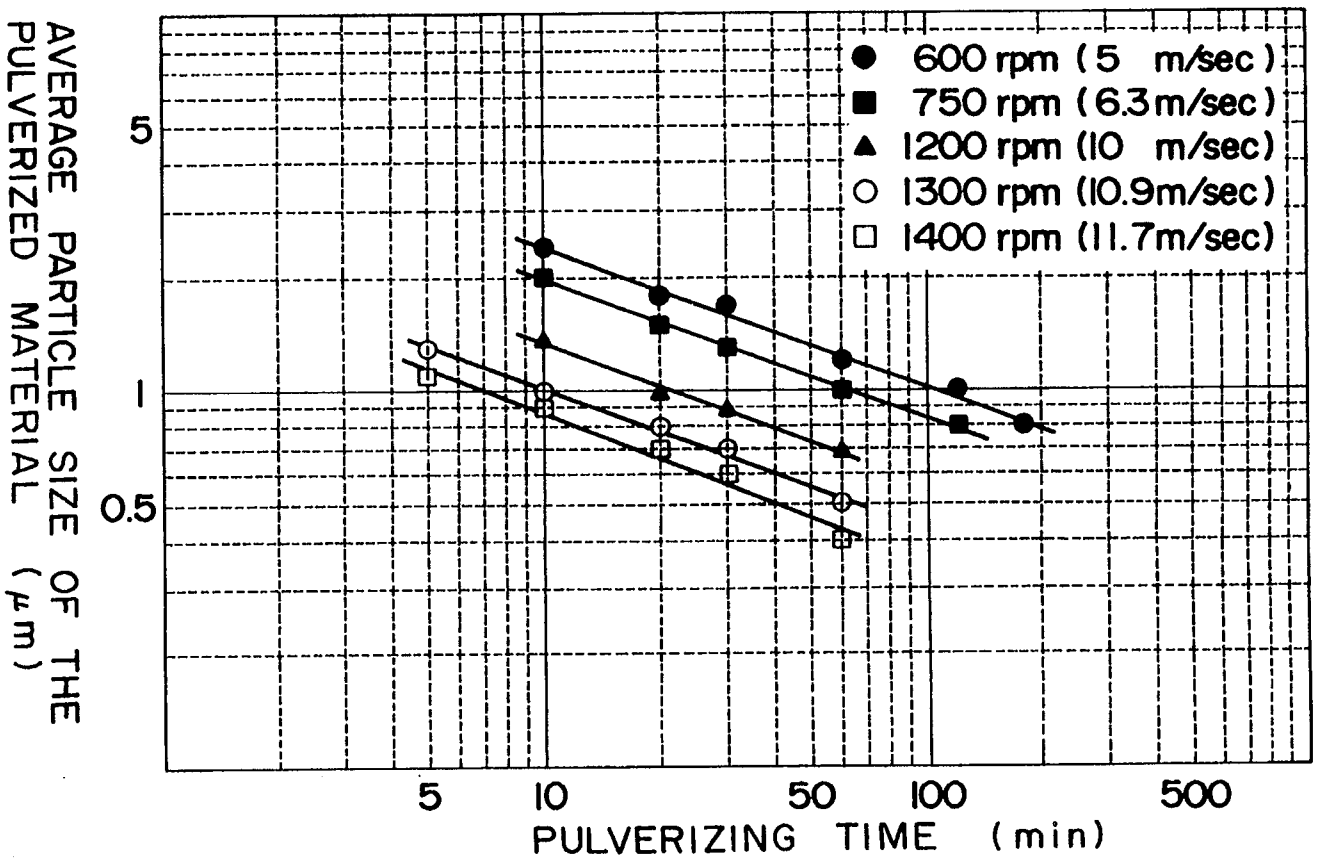
FIG. 11 shows the relationship between the average particle size of pulverized material and pulverizing time.

The processing apparatus included a container with an interior diameter of 145 mm and interior volume of 2.4 liters. There were eight sub-shafts, and each sub-shaft was equipped with 35 ring-shaped parts (the total number is therefore 280). Each ring-shaped part had an outside diameter of 40 mm, inside diameter of 20 mm, and were 3 mm thick. Amount of slurry composed of the heavy calcium carbonate was dispersed in water to create a ratio of 20 wt. %. The resulting slurry supply measured 0.9 liters, and accounted for 38% of the container volume. A 5 liters/min flow of water 15° C. was supplied to the jacket to act as a refrigerant. Slurry temperature during processing was maintained at about 35° C. Other conditions and results are shown in Table 1 and FIG. 11. An SK Laser Microanalyzer (PRO-7000S model; manufactured by Seishin Enterprises K.K.) was used to measure particle distribution before and after processing. As Table 1 and FIG. 11 indicate, the solid particles were crushed to submicron levels in a very short period of time.

TABLE 1

| No. | Shaft RPM [rpm] | Peripheral speed of ring [m/sec] | Average particle size of the pulverized material at a given interval [μm] 5[min] | 10 | 20 | 30 | 60 | 120 | 180 |
|---|---|---|---|---|---|---|---|---|---|
| 1 | 600 | 5 | | 2.4 | 1.8 | 1.7 | 1.2 | 1.0 | 0.8 |
| 2 | 750 | 6.3 | | 2.0 | 1.7 | 1.3 | 1.0 | 0.8 | |
| 3 | 1,200 | 10 | | 1.4 | 1.0 | 0.9 | 0.7 | | |
| 4 | 1,300 | 10.9 | 1.3 | 1.0 | 0.8 | 0.7 | 0.5 | | |
| 5 | 1,400 | 11.7 | 1.1 | 0.9 | 0.7 | 0.6 | 0.4 | | |

Figure 12A:
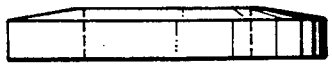
FIG. 12 shows an example of the ring-shaped part used in this invention: (a) is a front view, and (b) is a perspective view.
Figure 12B:
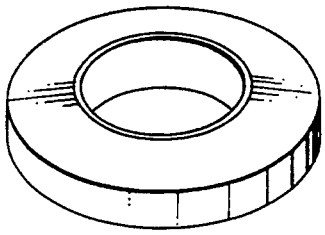
Figure 13A:
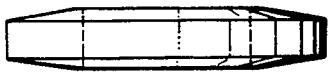
FIG. 13 shows another example of the ring-shaped part used in this invention: (a) is a front view, and (b) is a perspective view.
Figure 13B:
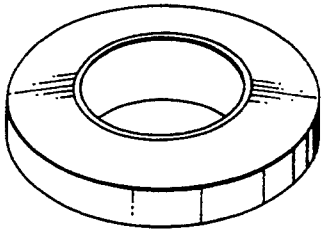
Figure 14A:
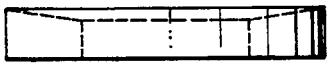
FIG. 14 shows still another example of the ring-shaped part used in this invention: (a) is a front view, and (b) is a perspective view.
Figure 14B:
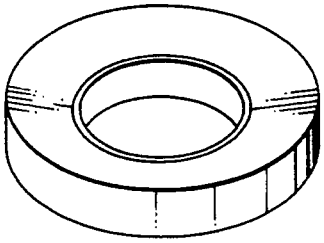
Figure 15A:
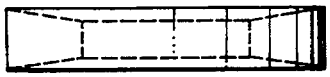
FIG. 15 shows yet another example of the ring-shaped part used in this invention: (a) is a front view, and (b) is a perspective view.
Figure 15B:
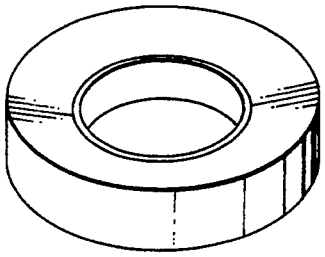

FIGS. 12–15 show other examples of ring-shaped parts. As mentioned previously, the use of ring-shaped parts with parallel top and bottom surfaces, as shown in FIG. 4, allows granular or slurry raw materials to enter between the ring-shaped parts, creating a lubricating effect that makes the movement of the ring-shaped parts smoother. When certain raw materials are used, particular highly-concentrated slurries with small solid particles, an adhesive effect results instead, and the top and bottom ring-shaped parts stick together. As a result, the parts no longer move independently. Rather, they become integrated like the rollers of the apparatus described in the aforementioned Japanese Publication of Unexamined Patent Application KOKAI Number SHO58-17851. In this state, the ring-shaped parts cannot revolve smoothly and grinding performance suffers. If the ring-shaped parts are made of ceramics, they may even break. It may be better then, to angle the top and bottom of the ring-shaped parts with respect to each other, rather than making them parallel, and to minimize the top and bottom areas of contact. For instance, the problem can be solved by thinning the ring-shaped parts towards the periphery, as shown in FIGS. 12 and 13, or, as making them thinner towards the center as shown in FIGS. 14 and 15.

By doing so, the ring-shaped parts will revolve smoothly regardless of the type of raw material processed.

Figure 16A:
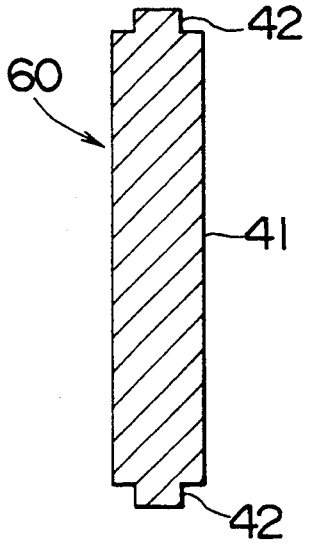
FIG. 16 shows an example of the sub-shaft used in this invention: (a) is a longitudinal sectional view, and (b) is a perspective view.
Figure 16B:
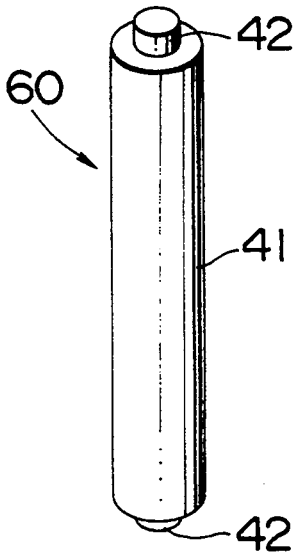
Figure 17:
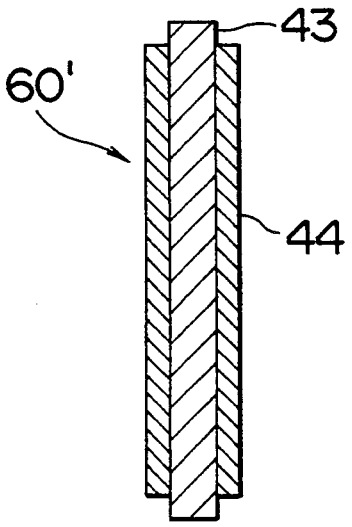
FIG. 17 is a longitudinal sectional view showing another example of the sub-shaft used in this invention.
Figure 18:
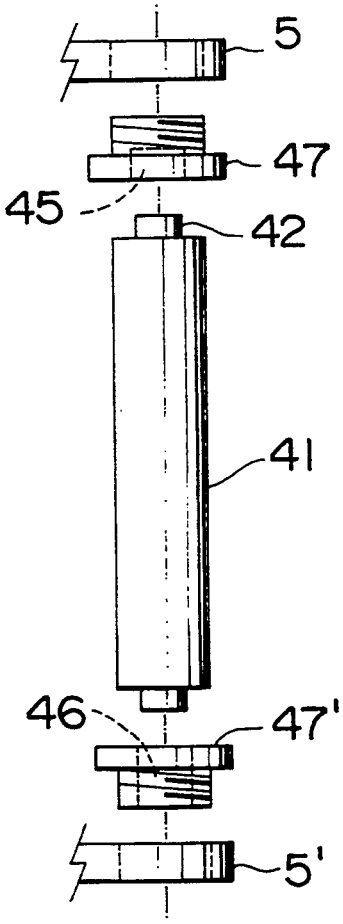
FIG. 18 shows some main points of fixing the sub-shaft of this invention to the presser plates.

Next, other models of the sub-shaft, and the method for fixing the presser plates of these models are shown in FIGS. 16–18. When large, dry granular materials are processed, material will enter between sub-shaft (6) and collar (8), and become stuck there. This impairs the movement of collar (8), and the sliding action of the ring-shaped parts (9) will cause local wear and breakage to occur in a short period of time. In addition, the movement of the ring-shaped parts (9) also becomes impaired, and pulverizing performance can suffer markedly. Sub-shafts (60), shown in FIG. 16, are used in such cases. The sub-shafts (60) have shapes in which cylindrical protrusion (42), with smaller diameter but the same central axis is connected to the top and bottom planes of the comparatively long and narrow cylindrical middle portion (41). If the ring-shaped parts (9) are made from ceramic material, a ceramic should also be used for sub-shaft (60) as well, but stress will be concentrate at the connection between the cylindrical portion and the cylindrical protrusion. In such a case, as shown in FIG. 17, the core portion may be made from a material such as stainless steel, and collars (44) made of ceramics are affixed.

In FIG. 18, a method for fixing the sub-shafts to the presser plates is shown.

In this figure, numerals (5) and (5') indicate top and bottom presser plates, and (47) and (47') top and bottom bushings. At the bottom of the top bushing (47), a concave (45) portion which will support the protrusion portion (42) of sub-shaft (60) is configured so that it can freely revolve. The bottom bushing (47') has a hole (46) configured in the same way. No concavity was included on the bottom bushing (47') in order to prevent processed materials from accumulating in it. These bushings for example, are partially threaded, and are screwed into the tip of the presser plates to secure them.

Figure 19A:
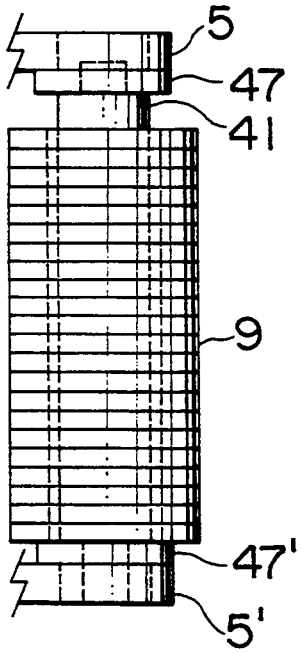
FIG. 19 shows a detailed drawing of an important part showing an example of the revolving mechanism of this invention: (a) is a front view, and (b) is a perspective view.
Figure 19B:
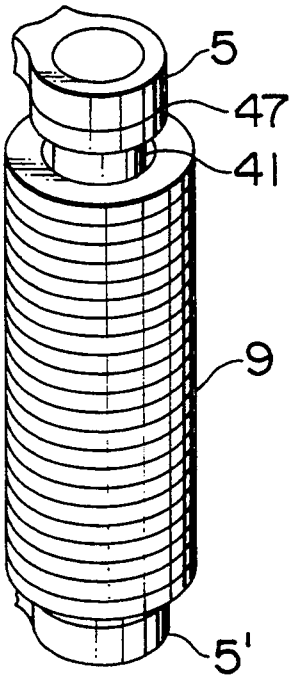
Figure 20A:
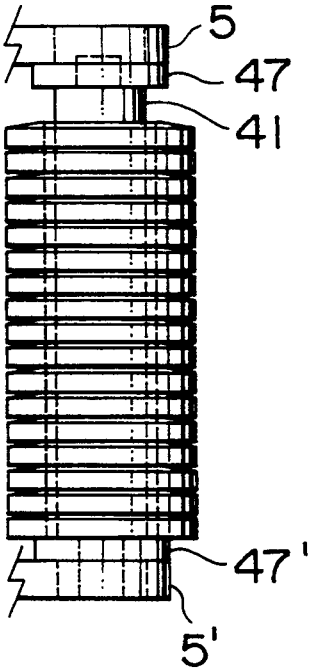
FIG. 20 shows an important part showing an example of the revolving mechanism of this invention: (a) is a front view, and (b) is a perspective view.
Figure 20B:
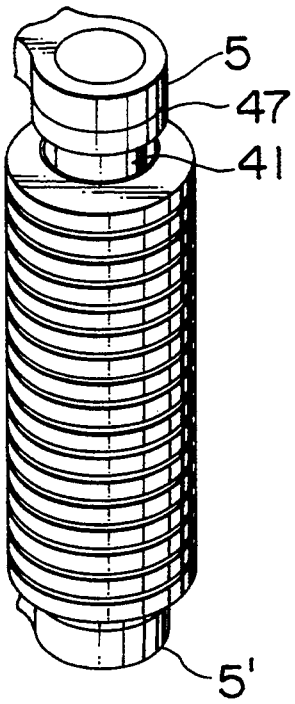

FIGS. 19 and 20 are detailed drawings of the essential parts of the rotary mechanism, which have the ring-shaped parts shown in FIGS. 4 and 12 mounted on the sub-shaft of the above-mentioned structure.

As explained in detail above, solid substances were rapidly crushed into extremely fine particles by granular substance processing apparatus, which consisted of a revolving main shaft installed in the center of a container, and multiple sub-shafts supported around said main shaft at certain intervals. Multiple ring-shaped parts were fitted to said sub-shafts in such a manner that sufficient space existed between the sub-shafts, and said ring-shaped parts were made to come into contact with the inner walls of the container. Furthermore, the above-mentioned apparatus made mixed and dispersed granular material and liquid, and uniformly and efficiently dispersed pigments and paints.

In addition, the above-mentioned apparatus simplifies disassembly and cleaning of the rotary mechanism, and includes measures to simplify repair of wear-related damage.

I claim:

1. A granular processing machine comprising:
a container;
a main shaft positioned in said container and rotatable in said container;
a first presser plate rigidly fixed to said main shaft and rotatable with said main shaft;
a second presser plate rigidly fixed to said main shaft at a position axially spaced from said first presser plate and rotatable with said main shaft;
a plurality of subshafts positioned circumferentially along said first and second presser plates, and supported by said first and second presser plates, said plurality of subshafts being substantially parallel to said main shaft;
a plurality of ring-shape members rotatably attached around each of said plurality of subshafts, said plurality of subshafts and said plurality of ring-shape members being movable with said first and second presser plates about said main shaft, said plurality of ring-shape members having an inner diameter larger than an outer diameter of said plurality of subshafts to cause an outer circumference of said plurality of ring-shape members to contact an inner circumference of said container.

2. A granular material processing machine described in claim 1, wherein agitation blades are mounted on one of said first and second presser plates.

3. A machine in accordance with claim 1, wherein:
each of said first and second presser plates have a plurality of arms equal in number to said plurality of subshafts, said plurality of arms extending radially from said main shaft.

4. A machine in accordance with claim 1, further comprising:
means for stopping material from moving out of said container, said means including a lid, a rotary circular disc connected to said main shaft, blades attached to said rotary circular disc and said blades extending radially from said main shaft, and a cylindrical member attached to said lid and surrounding said rotary circular disc.

5. A granular material processing machine described in claim 4 wherein a baffle plate is provided between said subshafts and said means to stop moving out of material.

6. A machine in accordance with claim 5, wherein:
said baffle plates is formed into a ring shaped and include a cylindrical portion formed at an internal circumference of said baffle plates and extending towards an inside of said container, an external circumference of said baffle plate being positioned in contact with said internal circumference of said container.

7. A machine in accordance with claim 1, further comprising:
a plurality of collars, each of said plurality of collars positioned rotatably around said plurality of subshafts and inside a set of said plurality of ring-shape members, said plurality of collars having an inner diameter larger than an outer diameter of said plurality of subshafts and an outer diameter smaller than said inner diameter of said plurality of ring-shape members to cause said ring-shape members to rotate freely about said plurality of subshafts.

8. A machine in accordance with claim 1, wherein:
said container includes jacket means for receiving coolant to cool material in said container.

9. A machine in accordance with claim 1, wherein:
a set of said plurality of ring-shape members are positioned axially adjacent each other on one of said plurality of subshafts and each of said plurality of ring-shape members being shaped to have a contact area between said plurality of ring-shape members smaller in size than a maximum radial thickness of said plurality of ring-shape members.

10. A machine in accordance with claim 9, wherein:
a lid is connected to said container and said baffle plate is connected to said lid.

11. A machine in accordance with claim 1, wherein:
said plurality of subshafts have a middle portion and end portions, said end portions having a smaller outer diameter than said middle portion, said middle and end portions being substantially concentric;
said first and second presser plates define bushing holes and include bushing means positioned in said bushing holes for rotatably supporting said plurality of subshafts about an axis of said bushing holes.

12. A machine in accordance with claim 11, wherein:
said middle portion of said plurality of subshafts is formed by a ceramic collar.

13. A machine in accordance with claim 1, wherein:
an axial thickness of said plurality of ring-shape members varies with one of said inner circumference and an outer circumference being smaller than the other.

14. A granular processing machine comprising:
a container;
a main shaft positioned in said container and rotatable in said container;
a first presser plate rigidly fixed to said main shaft and rotatable with said main shaft;
a second presser plate rigidly fixed to said main shaft at a position axially spaced from said first presser plate and rotatable with said main shaft;
a subshaft radially spaced from said main shaft and fixed to said first and second presser plates to rotate with said first and second presser plates about said main shaft;
a plurality of ring-shape members positioned substantially concentrically and rotatably around said subshaft, said subshaft and said plurality of ring-shape members being movable with said first and second presser plates about said main shaft, said plurality of ring-shape members having an inner diameter larger than an outer diameter of said plurality of subshafts to cause said plurality of ring-shape members to be radially moveable into contact with an inner circumference of said container.

15. A machine in accordance with claim 14, wherein:
each of said plurality of ring-shape members are independently radially movable;

said subshaft is radially fixed to said first and second presser plates and extends from said first presser plate to said second presser plate.

16. A machine in accordance with claim 14, wherein:

said subshaft is radially fixed and rotatably connected to said first and second presser plates.

17. A machine in accordance with claim 14, wherein:

said subshaft is rigidly connected to said first and second presser plates;

a collar is positioned substantially concentrically around said subshaft and inside said plurality of ring-shape members, said collar being radially spaced from said subshaft and said plurality of ring-shape members to cause said plurality of ring-shape members to be radially movable.

* * * * *